US008680435B2

(12) United States Patent
Bohlender et al.

(10) Patent No.: US 8,680,435 B2
(45) Date of Patent: Mar. 25, 2014

(54) ELECTRICAL HEATING DEVICE

(75) Inventors: Franz Bohlender, Kandel (DE); Michael Niederer, Kapellen Drusweiler (DE); Michael Zeyen, Herzheim-Hayna (DE); Rainer Wuenstel, Neustradt (DE); Detlef Stephan, Landau-Moraheim (DE)

(73) Assignee: Catem GmbH & Co. KG, Herxheim bei Landau (DE)

( * ) Notice: Subject to any disclaimer, the term of this patent is extended or adjusted under 35 U.S.C. 154(b) by 1307 days.

(21) Appl. No.: 12/174,396

(22) Filed: Jul. 16, 2008

(65) Prior Publication Data

US 2009/0026189 A1 Jan. 29, 2009

(30) Foreign Application Priority Data

Jul. 18, 2007 (EP) ..... 07014115

(51) Int. Cl.
*H05B 1/00* (2006.01)

(52) U.S. Cl.
USPC ..... 219/202; 219/504; 219/505; 219/525; 219/536; 219/548

(58) Field of Classification Search
USPC ..... 219/202, 504, 525, 536, 537, 539, 540, 219/542, 546, 548, 550, 205–208, 505, 520
See application file for complete search history.

(56) References Cited

U.S. PATENT DOCUMENTS

| | | | | |
|---|---|---|---|---|
| 7,667,166 | B2 | 2/2010 | Zeyen et al. | |
| 2003/0205891 | A1 * | 11/2003 | Nass | 280/756 |
| 2005/0072774 | A1 | 4/2005 | Bohlender | |
| 2005/0127122 | A1 * | 6/2005 | McKenzie et al. | 224/547 |
| 2005/0175328 | A1 | 8/2005 | Pierron et al. | |
| 2005/0230377 | A1 * | 10/2005 | Bohlender et al. | 219/505 |
| 2006/0273078 | A1 | 12/2006 | Hong | |
| 2007/0068913 | A1 * | 3/2007 | Zeyen et al. | 219/201 |

FOREIGN PATENT DOCUMENTS

| | | |
|---|---|---|
| EP | 1 564 503 A | 8/2005 |
| JP | 7201454 A | 8/1995 |

* cited by examiner

*Primary Examiner* — Dana Ross
*Assistant Examiner* — James Sims, III
(74) *Attorney, Agent, or Firm* — Boyle Fredrickson, S.C.

(57) ABSTRACT

An electrical heating device includes a flat heating block, which is held in a housing forming oppositely situated frame openings and which comprises parallel layers of heat dissipating and heat generating elements. The heat generating elements on the face side have fitting elements projecting beyond the heating block, and fitting element receptacles assigned to these fitting elements are formed on the housing. The fitting elements and the assigned fitting element receptacles of different heat generating elements are formed such that the heat generating elements cannot be inserted at just any random place in the housing.

15 Claims, 7 Drawing Sheets

ELECTRICAL HEATING DEVICE

BACKGROUND OF THE INVENTION

1. Field of the Invention

The present invention relates to an electrical heating device, which is used in a motor vehicle in particular as an auxiliary heater for heating air, with a heating block, which is held in a housing forming an oppositely situated frame opening and comprises parallel layers of heat dissipating and heat generating elements.

2. Description of the Related Art

An auxiliary heater of this nature for conditioning the air in the interior of a motor vehicle is for example known from EP 1 564 503. The heat generating elements of the heating block normally comprise several PTC heating elements which are provided overlapping in one plane and are arranged between printed conductors which are normally formed by sheet metal bands. These printed conductors carry current with different polarities. The PTC elements can be glued to these printed conductors. It is also possible for the printed conductors to contact the PTC heating elements under tension. In any case it must be ensured that for extracting the heat produced by the PTC heating elements and for feeding current, good contact between the printed conductors and the PTC heating elements exists.

One or more heat generating elements can be provided as part of the heating block. The heat produced by the heat generating elements is dissipated through heat dissipating elements to the medium to be heated, i.e. the air. It flows through the housing through the two frame openings which accommodate the flat heating block. The frame openings here lie normally parallel to one another on oppositely situated sides of an essentially flat, frame-shaped housing. With regard to the most economical manufacture of the electrical heating device, the heat dissipating elements are generally formed from meander-type bent sheet strips, which form corrugated ribs. These corrugated ribs contact heat dissipating elements on one or both sides. Consequently, the heating block comprises several layers of heat dissipating and heat generating elements, wherein it must also be ensured with regard to the thermal emission that the heat dissipating elements have a good contact to the heat generating elements. Also in this respect, the heat dissipating elements can be permanently joined to the heat generating elements and/or contact them under tension through at least one spring element accommodated in the housing.

Instead of a meander-type sheet metal band, the heat dissipating element can also be formed by an extruded aluminium profile, which forms ridges, which extend essentially at right angles to the layers of the layer structure comprising the heat dissipating and the heat generating elements. In a case of this nature the printed conductor, i.e. the generally flat locating face, for the PTC heating element can be formed by the outer surface of an extruded aluminium profile of this nature. With both alternatives, corrugated rib element or extruded profile, the locating face for the PTC heating elements is formed electrically conducting and is electrically connected to contacts which are normally mounted insulated from one another. In the first case the contacts are generally formed by the exposed ends of the sheet metal bands.

The layered heating block consisting of parallel heat dissipating and heat generating elements, optionally with one or more additional spring elements extending parallel to it, is preferably mounted in a housing with a U-shaped cross-section. When the layer structure is subjected to the pressure of a spring, the frame has to be dimensioned such that the spring force can be continuously maintained even at increased temperatures. Here it should be noted that the insulating frame is nowadays manufactured as an injection moulded part, due partially to economical reasons. Normal housings nowadays consist of a housing lower part and a housing upper part. The housing lower part here forms a receptacle for the individual elements of the heating block and, where required, of the spring element. The individual elements of the heating block are arranged in this housing lower part. Then the heating block is enclosed in the housing by joining the housing upper part and the housing lower part. To achieve this, edges which surround the frame openings can partially cover the heating block so that the heating block is enclosed between the frame openings and mounted in the housing. The two housing parts are then joined together, for example using a latching connection.

With this type of assembly there is the problem that the individual layers of the heating block must be arranged at a predetermined point in the housing. Since not every heat generating element is assigned its own contacts, the electrical conditions within the heating block must also be considered during assembly. However to minimise the manufacturing costs, there is also the desire to form the parts of the heating block as standardised as possible, so that identical components can be used for different layers of the heating block.

Furthermore, the housing itself should be able to be manufactured as simply as possible with regard to an economical manufacture of the electrical heating device. Here however, the particular requirements for the practical installation of one or more spring elements in the housing have to be followed when on joining the housing parts the heating block is already subjected to prestressing in the frame so that joining has to take place against this prestressing.

With regard to the previously discussed problems, in EP 1 564 503 an electrical heating device of the generic type has already been suggested in which the layers of the heating block including a spring element are first mounted in a housing lower part initially free of tension. A housing upper part, which can be connected to it, forms an oblique sliding surface which extends over the end of the spring element protruding up from the housing lower part in relation to the outer side of the heating block. When joining the housing upper part and housing lower part, the spring element is accordingly compressed in the direction of the heating block and contacts it prestressed.

This prior suggestion leads to a certain simplification during assembly, which however requires that the elements of the heating block, as also the spring element, are brought into the correct positions in the housing lower part. Furthermore, the housing implemented with this electrical heating device has various oblique surfaces, which are required for stressing and enclosing the spring element when joining the housing parts.

OBJECT OF THE INVENTION

The object of the present invention is to provide an electrical heating device which can be manufactured more simply and therefore more economically.

This object is solved according to the present invention by an electrical heating device having the features of flat heating block, which is held in a housing forming oppositely situated frame openings and which comprises parallel layers of heat dissipating and heat generating elements, wherein the heat generating elements have fitting elements. In addition, fitting-element receptacles correspond to the fitting element receptacles and are formed on the housing. The fitting elements and the assigned fitting-element receptacles corresponding to the fitting element receptacles of different heat generating elements are formed such that the heat generating elements cannot be inserted at just any random place in the housing. This differs from the generic form of electrical heating devices in that the heat generating elements have on their face side fitting elements projecting over the heating block and fitting element receptacles assigned to the fitting elements are formed on the housing and in that the fitting elements and the assigned fitting element receptacles of different heat generating elements are formed such that the heat generating elements cannot be inserted at just any random place in the housing.

With the present invention an electrical heating device is suggested in which through the special arrangement of individual heat generating elements by the formation of individual fitting elements with matching fitting element receptacles on the housing side, an assignment of individual heat generating elements to special positions within the heating block is provided. The individual heat generating elements of the heating block cannot accordingly be installed at just any random place in the housing. Whereas the position or the positions of certain heat generating elements with corresponding fitting elements within the housing is/are prescribed, the heat dissipating elements can for example be formed identically and in fact preferably as meander-type bent sheet metal strips which extend identically transverse to the layers of the layer structure.

For the purpose of the present invention fitting elements are taken in particular as parts of the heat generating elements which have no function other than the positioning and/or mounting of these elements in the housing. Fitting elements of this nature with otherwise no function are for example formed from position elements, which hold the PTC heating elements at predetermined places within the heat generating element, particularly by a positional frame made of an insulating material which form adjacently provided receptacles for in each case at least one PTC heating element. The fitting elements are here formed in particular by the ends of the corresponding positional frames. One end or both ends of the positional frames can have a specially shaped head for this, which can be introduced into a correspondingly shaped receptacle on the housing. A positional frame can have identical fitting elements on its respective face-side ends. These can however also vary and in fact such that each heat generating element has fitting elements which differ from the fitting elements of all other heat generating elements. Correspondingly, fitting element receptacles are formed on the housing for this so that a prescribed heat generating element in the housing can only be installed at a predetermined place within the housing. Along with fitting elements, which are formed by the positional frame and have no function other than the holding and positioning of the heat generating elements within the housing, individual sheet metal bands forming the printed conductors can be formed as fitting elements.

In this respect according to a preferred embodiment of the present invention it is suggested that the heat generating elements comprise sheet metal bands to which the PTC heating elements make electrical contact and which on the face side of the heating block are brought out of the plane of the associated heat generating element by bending and are passed through slots which are cut in the face side of the housing and that the bent sheet metal bands of different heat generating elements and the associated slots are formed such that the heat generating elements cannot be inserted at just any random place in the housing.

With this preferred embodiment the ends of the selected sheet metal bands, which are located in the heating block on the upper and lower sides of the respective positional frames and which contact the PTC heating elements arranged in the respective positional frame, are bent over on one or both sides on the face-side end of the heating block so that the sheet metal bands leave the plane which is taken up within the heating block by the corresponding heat generating element. At the end of the heating block the sheet metal bands accordingly extend normally at right angles to the layers of the heating block, but after a certain length, i.e. an offset in this lateral direction, are again bent back into their original alignment and passed through a slot, which is cut out on the face side on the housing, i.e. normally extending essentially parallel to the layers of the layer structure. Through the length of the offset, i.e. the distance between the slot and the associated heat generating element, an assignment of predetermined heat dissipating elements to predetermined positions within the housing can be achieved such that the heat generating elements cannot be inserted just at any random position in the housing, but rather at a specific, preferably unambiguous place.

With the present invention and the previously discussed further developments, assembly faults when arranging the individual layers of the layer structure within the housing before joining the housing parts are avoided. With the electrical heating device according to the invention individual elements of the heating block can only be installed at predetermined positions. The installation of the heat generating elements at a position, which is not admissible in design due to the arrangement and assignment of fitting elements and fitting element receptacles, is completely excluded. The fitting elements and the associated fitting element receptacles are designed with a certain amount of play so that the layers of the layer structure can be easily inserted despite the positive locking fit of the fitting elements in the fitting element receptacles and are generally held with limited movement with respect to the layers of the heating block. The tolerances are however not so large that just any random fitting element receptacle can accommodate any fitting element.

According to a preferred further development of the present invention the housing comprises a housing lower part, which forms a receptacle for the heating block and a frame surrounding the receptacle as well as the fitting element receptacles, and a housing upper part, which is connected to the housing lower part to enclose the heating block. The fitting element receptacles here are formed such that the fitting elements can be inserted in the housing lower part in a direction transverse to the plane in which the heating block extends. During the assembly of the heating device the individual layers of the heating block are accordingly inserted into the housing lower part, which is open on one side, in the direction of the frame opening formed by this housing lower part, until they reach the bottom of the receptacle. The fitting element receptacles, open in the insertion direction, here specify the easily recognisable position of the corresponding heat generating elements within the heating block. With regard to the unambiguous assignment with this preferred embodiment it is suggested that different fitting element receptacles are formed in the longitudinal direction of the heat generating elements with different lengths and/or in the transverse direction to the heat generating elements with different width.

The fitting elements of the individual heat generating elements can be widened similar to a hammer head, but be formed relatively short. Other fitting elements can be formed long and narrow in a ridge shape. Long, wide ridges can be provided, which protrude over the heat generating elements on one side. Very different profile shapes are conceivable, the corresponding profile shapes of which are assigned to the fitting element receptacles. For example, the fitting elements can in a plan view be formed round, elliptic, H or U-shaped on the still open housing lower part. The possible cross-sectional shapes previously discussed are normally moulded in one piece on the positional frame and normally joined to a thin ridge which connects the fitting element to the heating block.

For the further prevention of assembly faults, according to a further preferred embodiment of the present invention, it is suggested that the housing upper part has guide pins, which protrude from the cover of the housing upper part which encloses the heating block, are formed in one piece with said cover and correspondingly engage cut-out pin guides in the housing lower part, wherein the guide pins and the pin guides are formed correspondingly on the two housing parts such that the two housing parts can only be joined together in a certain alignment. This further development takes into account that although the cover can be formed as a type of unspecific cover, with regard to an accurate arrangement of parts of the heating block or of the spring device it is however preferable to form the housing upper part specifically and to provide it in a predetermined arrangement for enclosing the heating block and to form it for the adaptation of the cover to the design of the elements of the heating block and to attach it unambiguously to the housing lower part.

With regard to easy manufacture of the heating device according to the invention, in particular considering manufacture of the housing injection moulding techniques, according to a preferred aspect of the present invention it is suggested that the functional areas forming the receptacle and the pin guides as well as the contour surfaces of the housing lower part which give the outer contour as well as the functional areas forming the guide pins and the delimiting surfaces of the housing lower part delimiting the cover are exclusively formed such that they run parallel or perpendicular to the plane enclosing the frame opening. This embodiment has the advantage that an injection moulding tool for the manufacture of the housing lower part and housing upper part during the course of injection moulding of thermoplastics has no undercuts and due to the orthogonal alignment of the functional, contour and delimiting surfaces of the tool surfaces forming the housing parts, i.e. the injection moulding tool overall, can be manufactured in a simple manner using a face milling cutter. Breaking away from complicated injection moulding tools with a spark eroded surface forming the mould cavity, the injection moulding tool for the manufacture of the housing of the heating device according to the invention can be economically produced without special knowledge.

For the purpose of this further development, functional surfaces are taken to be those surfaces of the housing parts which delimit the receptacle for the heating block, facilitate the joining of the housing parts and guide the required relative movement of the housing parts for this. For the purpose of this further development, contour and delimiting surfaces are taken to be those surfaces of the housing parts which define the outer contour of the housing parts and the housing overall. Relatively narrow face sides or edge surfaces at which two plane surfaces meet at a right angle are not regarded as appropriate functional, contour and delimiting surfaces for the purpose of the invention. These face sides and edge surfaces can be rounded off or bevelled.

In this preferred embodiment the housing is normally formed as a rectangular component which encloses an essentially similarly essentially rectangular receptacle for the heating block and at both its outer sides prescribes in each case a similarly essentially similarly rectangular housing opening.

The housing lower part has for this a locating face running parallel to the corresponding housing opening and which similarly forms a functional surface for the purpose of the further development and is located against the heating block after insertion into the housing lower part. The pin guides lie exposed on the opposite side of the housing lower part. These pin guides are formed in at least one of the spars, preferably on the oppositely situated longitudinal spars of a frame element of the housing lower part which circumferentially surrounds and encloses the heating block. This frame element forms the major part of the housing lower part. Only in the region of the frame opening, which is formed by a face side of the frame element, struts extend, pass through the receptacle opening and are provided between the outer side of the housing and the heating block once it has been inserted into the housing lower part.

The housing upper part consists essentially of a cover, which extends parallel to the frame opening formed by the frame element and which forms the other frame opening and similarly has struts passing through it, preferably corresponding to the struts of the housing lower part. This cover is an essentially flat component with only surfaces running parallel or orthogonally to the frame opening of the upper part. From the inner surface of the cover the guide pins protrude which accordingly extend ridge-shaped at right angles to the plane which includes the frame opening. Preferably these guide pins are mainly, if not exclusively, provided on the longitudinal sides. On one, optionally on both, lateral sides of the housing upper part, a pin can furthermore be provided, which interacts with a recess formed correspondingly on the housing lower part, the said recess being omitted on the oppositely situated lateral side of the housing lower part, so that the housing upper part can only be practicably joined to the housing lower part in a certain alignment.

The housing of the electrical heating device of the present invention consists preferably solely of the two housing parts, i.e. the housing upper part and the housing lower part. A mounting flange and/or a control housing for controlling the heating block can be attached by welding, gluing or clipping to a face side of the housing from which electrical connecting elements protrude. These additional components are normally not part of the housing of the electrical heating device according to the invention. In a simplified embodiment its housing has a flat, simple, rectangular, box-shaped external contour.

The housing lower part normally forms the receptacle for the heating block. Where this is held under spring pressure in the housing, it is suggested according to a preferred further development of the invention that the housing lower part forms locating faces for the at least one spring element with which the heating block can be maintained under pretension in the receptacle. These locating faces extend exclusively parallel or perpendicular to the plane comprising the frame opening. Normally, those locating faces for the spring element which counter the spring force extend strictly at right angles to the plane which also contains the frame opening. In parallel to this and to a relatively slight extent, one or several stopping faces are also provided as locating faces for the at least one spring element, against which the spring element contacts once it has been inserted into the housing lower part. The stopping faces therefore prescribe the lowest position of the spring element in the housing lower part.

According to a further preferred embodiment of the present invention selected guide pins are formed as notched pins. This signifies firstly that a surface of the notched pin extending parallel to the movement of the joining of the housing lower part and housing upper part is located in the plane which also comprises the remaining guiding surfaces of the notched pins. The notched pin accordingly also provides guidance for the relative movement on joining the housing lower part and the housing upper part. According to a special feature of the present invention, the notched pin for the connection of the housing upper part and housing lower part with its latching surface runs into a window which is formed on the outer side of the housing lower part, and in fact there where the assigned pin guide runs. Also with regard to easy manufacture of the injection moulded plastic housing, the latching surface of the notched pin extends parallel to the plane which includes the frame opening. The latching counter surface formed by the window has a corresponding extension.

For further simplification of the manufacture of the injection mould, according to a further preferred embodiment of the present invention, it is suggested that a latching ridge of the notched pin, protruding beyond the latching surface, extends from the outer surface of the cover, turning into a recess which is formed on the outer edge of the cover. The latching ridge here extends preferably from the plane containing the frame opening to the latching surface and parallel to the guiding surfaces of the guide pins. As far as that goes, the preferred further development of the present invention facilitates simple machined processing for example with an end milling cutter, also for the tool surface of the injection moulding tool forming the notched pins. In this embodiment the recess is taken preferably as a contour which protrudes inwards from the face parting plane or edge side circumferentially surrounding the cover and in any case is located in the region of the outer surface of the latching ridge protruded by the latching surface.

Preferably, all the surfaces on the two housing parts extend exclusively parallel or perpendicular to a plane which includes the frame opening. Where the frame opening is used as the reference plane, this is done in the knowledge that the frame opening forms the bottom of an injection mould for the formation of a housing lower part or a housing upper part and in any case is located parallel to the parting plane of the injection moulding tool. As far as that goes, referencing to the frame opening implies simultaneously referencing to the parting plane of the injection moulding tool. Only edge surfaces between surfaces or face sides of housing parts which meet at right angles can be bevelled or rounded off according to a preferred embodiment of the present invention by milling or grinding of the edge surfaces or face sides of the moulding injection moulding tools. These face sides include for example the face-side end surfaces of the guide pins, i.e. the front surface of the corresponding guide pins in the insertion direction or the face sides of the guide pins formed on the respective ends which extend parallel to the insertion direction.

Further details and advantages of the present invention are given in the following description of an embodiment in conjunction with the drawing. This shows the following:

DETAILED DESCRIPTION OF THE PREFERRED EMBODIMENT

Figure 1:
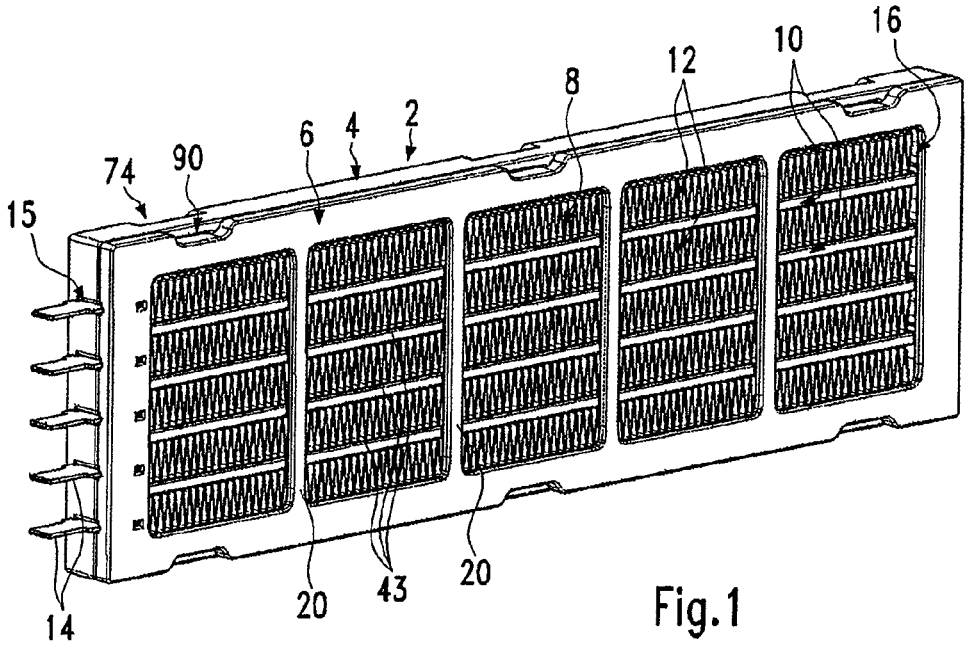
FIG. 1 a perspective side view of an embodiment of the electrical heating device.

FIG. 1 shows a perspective side view of an embodiment of the electrical heating device with a housing 2, consisting of a housing lower part 4 and a housing upper part 6. Both housing parts 4, 6 are joined together positively locked and accommodate a heating block 8, which consists of several heat generating elements 10 and heat dissipating elements 12 arranged in layers parallel to one another. The heat dissipating elements 12 are formed as corrugated rib elements from meander-type bent sheet metal strips.

Five contact lugs 14, arranged one over the other in the transverse direction protrude over a face side of the housing 2. The contact lugs pass through the housing 2 at the cut-out slots 15, each of which accommodate one contact lug and are mainly formed by the housing lower part 4, but are complemented on a face side by the housing upper part 6.

The housing 2 has two oppositely situated frame openings, of which in FIG. 1 only the frame opening 16 formed by the housing upper part 6 can be seen. The frame opening formed by the housing lower part 4 can be seen in FIG. 4 and is identified with the reference numeral 18. The frame openings 16, 18 are each interspersed with struts 20, which extend at right angles to the layers of the heating block 8 and which join together longitudinal spars oppositely situated to one another on the housing lower part 4 and housing upper part 6.

Figure 2:
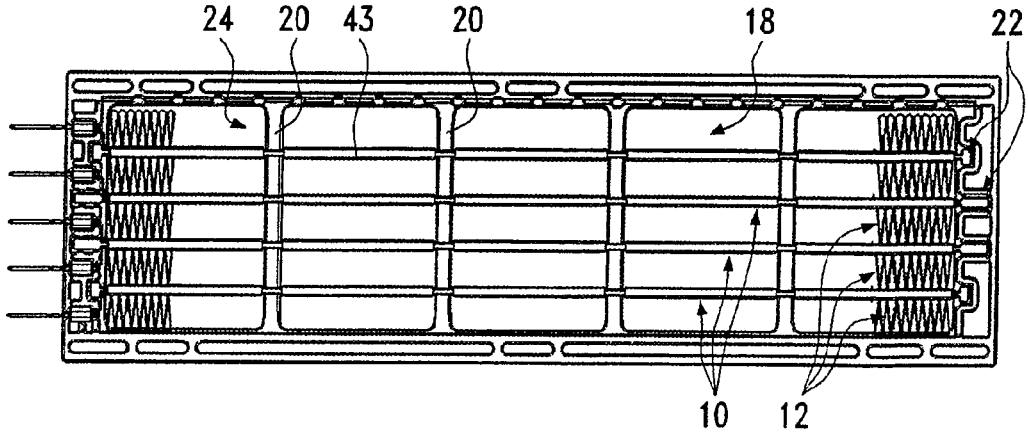
FIG. 2 a side view of a housing lower part with an installed heating block from the embodiment illustrated in FIG. 1.

FIG. 2 illustrates details of the heating block 8 and its accommodation in particular in the housing lower part 4 and illustrates the housing lower part 4 in a plan view with the housing upper part removed. The heat dissipating elements 12 are only illustrated incomplete on the respective face side ends of the housing lower part 4. Accordingly, the illustration in FIG. 2 provides a view onto the frame opening 18 formed by the housing lower part 4.

As can be seen, the illustrated embodiment has four heat generating elements 10, which are each insulating on the face side and are accommodated with a certain movement transverse to the layers of the layer structure (heating block 8) in the housing lower part 4. The housing lower part 4 has fitting element receptacles 22 for this, which open to a receptacle 24, which is essentially formed by the housing lower part 4 and accommodates the heating block 8. In the illustrated embodiment on each face side of the housing lower part 4 two different types of fitting element receptacles 22*a*, 22*b* are provided (cf. also FIG. 3). Corresponding to the geometry of the fitting element receptacles 22, the heat generating elements 10 have on their face side ends fitting elements 26*a*, 26*b*, which each only fit into the appropriate corresponding fitting element receptacle 22*a* or 22*b*. Here the corresponding fitting element receptacles 22 are matched to the correspondingly provided fitting elements 26 such that the heat generating elements 10 can move a few tenths of a millimeter transverse to the longitudinal extent of the layers of the heating block 8 in the housing 2. The outer fitting elements 26*a* are formed as hammer heads and engage appropriately formed fitting element receptacles 22*a*. In the longitudinal direction of the heat generating elements 10 these are substantially shorter than the second, centrally provided fitting element receptacles 22*b*. The fitting elements 26*b* assigned to these longitudinal fitting element receptacles 22*b* are bar-shaped and less wide than the hammer-head shaped fitting elements 26*a*. Due to this special design the central heat generating elements 10 do not fit into the outer positions for heat generating elements 10 on the heating block. In a corresponding manner the outer heat generating elements cannot be arranged in the centre of the heating block, i.e. inserted into the housing 2.

Whereas the heat generating elements 10 cannot be inserted at just any random place in housing 2, the heat dissipating corrugated rib elements 12 are produced non-specifically and initially as longitudinal sections of a meander-type bent sheet metal strip and are then cut to length from this endless material. Each individual heat dissipating element 12 can be inserted at any position for a heat dissipating element within the heating block 8.

The fitting elements 26 are formed in one piece on a positional frame 28, which can be seen in FIGS. 6 and 7 and are explained in more detail with reference to these figures. The positional frame 28 consists of an insulating material and is used for positioning the PTC heating elements 30. Here, for each individual PTC heating element 30 a receptacle 32 is cut out in the positional frame 28, which circumferentially holds and configures this PTC heating element. On both sides of each of the PTC heating elements 30, which are arranged adjacent to one another on one plane, sheet metal bands 34, 36 make contact, which form electrical printed conductors for powering the PTC heating elements 30 and via which the heat produced by the PTC heating elements is passed to the heat dissipating elements 12 by means of thermal conduction. These are located directly on the sheet metal bands 34, 36.

The face side ends of the positional frames 28 are extended by a fitting element ridge 38 beyond the position of the sheet metal bands 34, 36. At the outer ends of the fitting element ridges 38 there are the respective fitting elements 26 of the positional frame 28. As illustrated by the cross-sectional view along the line VII-VII drawn in FIG. 6 (cf. FIG. 7), most of the extent of the positional frame 28 in the width direction is taken up by the respective sheet metal bands 34, 36. In the cross-sectional view at the side next to the sheet metal bands 34, 36 the positional frame has retaining ridges 40, which are provided immediately adjacent to the side edge of the sheet metal bands 34, 36 and protrude over the corresponding sheet metal bands 34, 36 on the upper side and overlap them at the outside, preferably touching the printed conductors 34, 36 and making contact to them. In the illustrated embodiment the retaining ridges 40 are formed as a single part in the course of injection moulding, initially as protrusions extending at right angles to the principal extension direction of the positional frame 28. The spacing of oppositely situated protrusions is selected such that the sheet metal band 34 or 36 just fits between these protrusions.

The one-part component manufactured in this way by means of injection moulding is then fitted with the main parts of the heat generating element 10, i.e. the PTC heating elements 30 are inserted into the corresponding receptacle 32 and surrounded on both sides by the sheet metal bands 34, 36. Thereafter the recesses are plastically deformed inwards, comprehensively forming the printed conductors 34, 36. Here, normally hot forming is applied in which the material forming the retaining ridges 40 is heated locally in the region of the sheet metal bands 34, 36 and is thus softened. The means employed in each case can for example locally heat the positional frame 28 by means of hot air or thermal conduction. In the case of heating using thermal conduction the means causing the heating is preferably formed by a tool which simultaneously carries out the shaping of the retaining ridges 40.

The retaining ridges 40 are not formed continuously in the longitudinal direction of the heat generating element 10, but rather are provided in sections 40.1 to 40.5. These sections 40.1 to 40.5 leave a passage 41 free between them which is formed such that in each case a strut 22 fits between the sections 40.1; 40.2; 40.3; 40.4 or 40.5 in the width direction. The section formed by the passage 41 protrudes with respect to the outer surface of the retaining ridges 40 in each case so far inwards that at least half the thickness of the struts 22 fits between the retaining ridges 40 and is accommodated there.

However, a positive locking engagement between the struts 22 and the positional frame 28 is missing in a direction transverse to the layers of the heating block 8 so that movement transverse to the layers of the heating block 8 is provided between the struts 22 of the housing parts 4, 6, which can also be designated as the first strut and the retaining ridges 40 which can be designated as the second strut 43.

The heat generating element 10 is formed as a preassembled component and can thus be handled during assembly without the risk that the printed conductors 34, 36 or even the PTC heating elements 30 inserted in the positional frame 28 will be lost. It must however be pointed out that normally the retaining ridges only fix the sheet metal bands 34, 36 in the positional frame, but do not contact them with contact pressure against the PTC heating elements 30, which is sufficient to reliably power the PTC heating elements 30 in operation. With the embodiment discussed within the scope of the present invention this is in any case carried out by a spring element which is explained in more detail with reference to FIGS. 8 to 10.

First however, some features will be dealt with which ensure that parts of the heating block 8 cannot be installed just at any random place within the housing 2.

Figure 3:
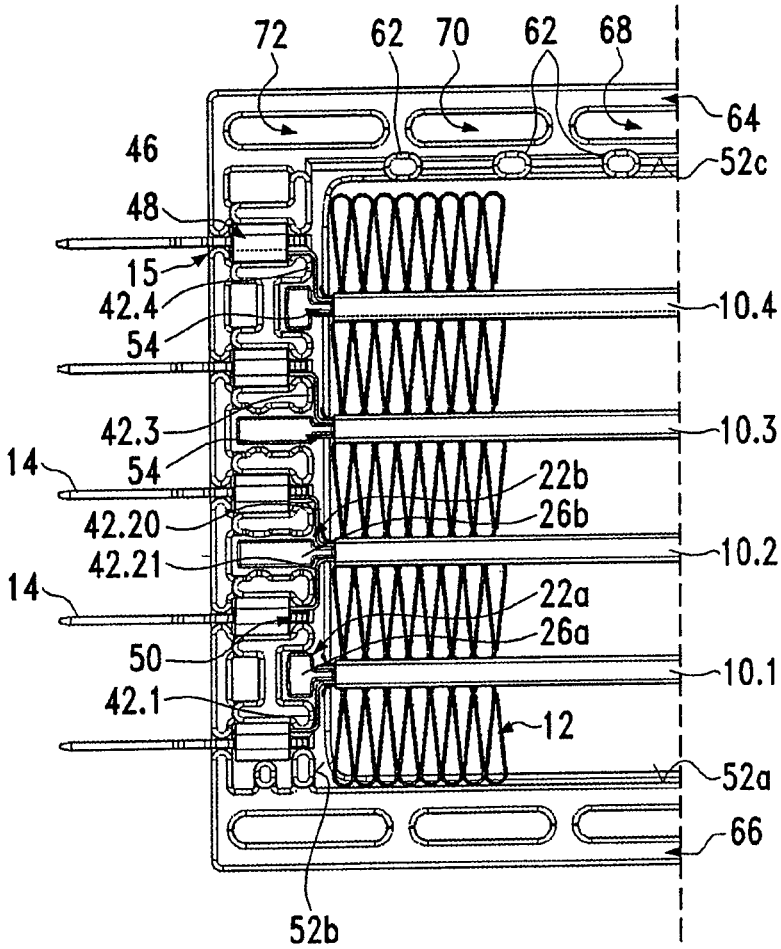
FIG. 3 an enlarged detail from the illustration according to FIG. 2.
Figure 6:
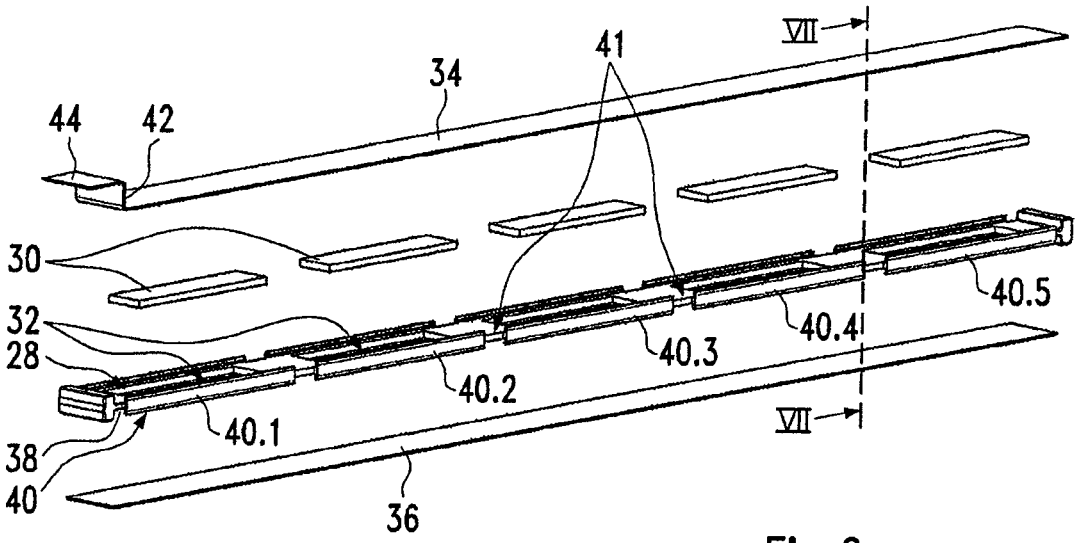
FIG. 6 a perspective exploded view of a heat generating element of the electrical heating device according to FIG. 1.
Figure 7:
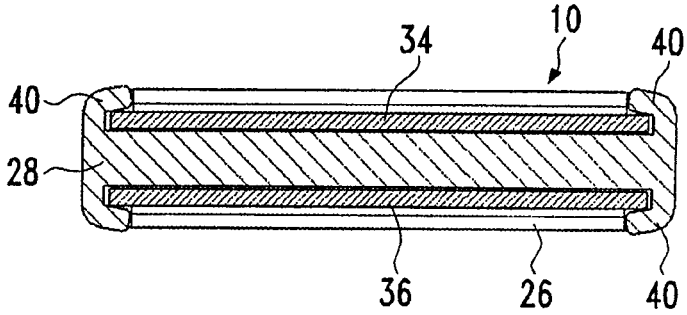
FIG. 7 a sectional illustration along the line VII-VII according to the illustration in FIG. 6 of an assembled heat generating element.

As can be seen, in particular from FIGS. 3 and 6, a sheet metal band, i.e. the sheet metal band 34 illustrated in FIG. 6, is bent out of the plane of the heat generating element 10. Consequently, an offset 42 is produced between the plane in which the sheet metal band 34 contacts the PTC heating elements 30 and a free end 44 which extends parallel to the first mentioned principal section of the sheet metal band 34 due to being again bent, but in the opposite direction. As can be seen from FIG. 3, this free end 44 is mechanically and electrically connected by a crimping element 46 to the assigned contact lug 14.

The upper heat dissipating elements in FIG. 3 designated with reference numerals 10.3 and 10.4 have an offset 42.3 and 42.4 projecting from the upper sheet metal band 34 upwards. The lower heat generating element 10.1 has an offset 42.1 projecting downwards. The sheet metal bands 34, 36 of the heat generating element 10 designated with reference numeral 10.2 are bent on both sides to form an offset 42.20 or 42.21 and each is provided with a contact lug 14. Due to these differences there is the possibility of preventing interchanging the positions of the heat generating elements 10.3 and 10.2 within the housing 2. In this case, due to the design of the contact lug receptacles 48, the embodiment permits interchanging of the two central heat generating elements 10.2 and 10.3. An appropriate interchangeability is also given for both outer heat generating elements 10.1 and 10.4.

The slots 15 previously mentioned with reference to FIG. 1 extend from the outer side of the housing 2 and run into the lug receptacles 48 widened in each case with respect to the slots 15. Behind this contact lug receptacle 48 a constricted slot 50 is in turn formed, which can accommodate a sheet metal piece shaped by punching and forming the contact lug 14 as well as the free end 44 of the assigned sheet metal band 34.

The housing lower part 4 can be formed in an economically manufactured injection mould, because all the surfaces significant for the housing 4 extend parallel or at right angles to the frame opening 18 of the housing lower part 4.

Thus, the housing lower part 4 has firstly frame surfaces 52*a-d* which essentially run at right angles to one another, which circumferentially surround the heating block 8 and run at right angles to the plane which contains the frame opening 18. On the face side, on which the contact lugs 14 are brought out of the housing lower part 4, the corresponding frame surface 52*b* opens outwards over four fitting element receptacles 54, the principal walls of which also extend at right angles to the plane which contains the frame opening 18. Those functional surfaces of the housing lower part 4, which essentially form the contact lug receptacles 48 as well as the slots 15 or 50 leading to them as well as those walls which delimit the fitting element receptacle 22 and are illustrated in FIG. 3, have an appropriate extent. The above described receptacles 15, 22, 50 and 54 are delimited on the side of the housing lower part 4 by a bottom, which runs parallel to the plane which contains the frame opening 18 of the housing lower part 4. This receptacle bottom is identified in FIG. 4 with the reference numeral 56. This bottom 56 also forms the inner surface of the struts 22 as well as on one hand limit stops 58, 60 at the edge for the spring element still to be explained as well as on the other hand the outer heat dissipating element 12 located on the oppositely situated longitudinal side. These limit stops 58 or 60 are in turn parallel to the plane which also contains the frame opening 18.

The inner surface of the housing lower part 4, which is formed on the face side of the face side ends of the walls which form the fitting element receptacles 22 or the contact lug receptacles 48, runs parallel to this plane. On a longitudinal side this upper edge is formed by spacers 62, which project over the frame surface 52*c* to the receptacle 24 and its function will be dealt with in the following description of the spring element. Below this upper plane of the inner surface of the housing lower part 4 there are the inner surfaces 63 of the two longitudinal spars 64, 66 of the housing lower part 4, which however project so far beyond the limit stops 58, 60 at the edge that the heating block 8 is almost completely circumferentially held, i.e. with more than 70% of its height extent, in the housing lower part 4. The longitudinal spars 64, 66 are interspersed by pin guides 68, 70, 72, which extend at right angles to the plane which contains the frame opening 18. The pin guides 68, 70, 72 intersperse in sections essentially the whole longitudinal extent of the longitudinal spars 44, 66.

In the centre of the respective longitudinal spars 64, 66 there is a pin guide 70, which is formed with a relatively short length and opens into a window 74 located on the outside of the housing lower part 4. Adjacent to this central pin guide 70, pin guides 68 are provided which extend in each case over about ⅓ of the length of the longitudinal spars 64, 66. On the outer end of these pin guides 68 there are in turn pin guides 70 with assigned windows 74, as described above. On the face side ends of the longitudinal spars 64, 66 again relatively small pin guides 72 are formed which extend from the inner surface of the longitudinal spars 64, 66 to the outer surface of the housing lower part which also contains the frame opening 18.

The functional surfaces forming or delimiting the pin guides 68, 70, 72 all extend at right angles to the plane which contains the frame opening 18. Only the face side edges of the corresponding openings 68 to 72 are slightly bevelled or rounded off in order to facilitate the introduction of corresponding guide pins 76 to 80 of the housing upper part 6. For easier joining of the housing lower part 4 and housing upper part 6, furthermore the free ends of the walls are also bevelled or rounded off which delimit the spacers 62 as well as the receptacles 22*b*, 15, 50, 48 at the ends and form the upper ends of the spacers 62.

Figure 5:
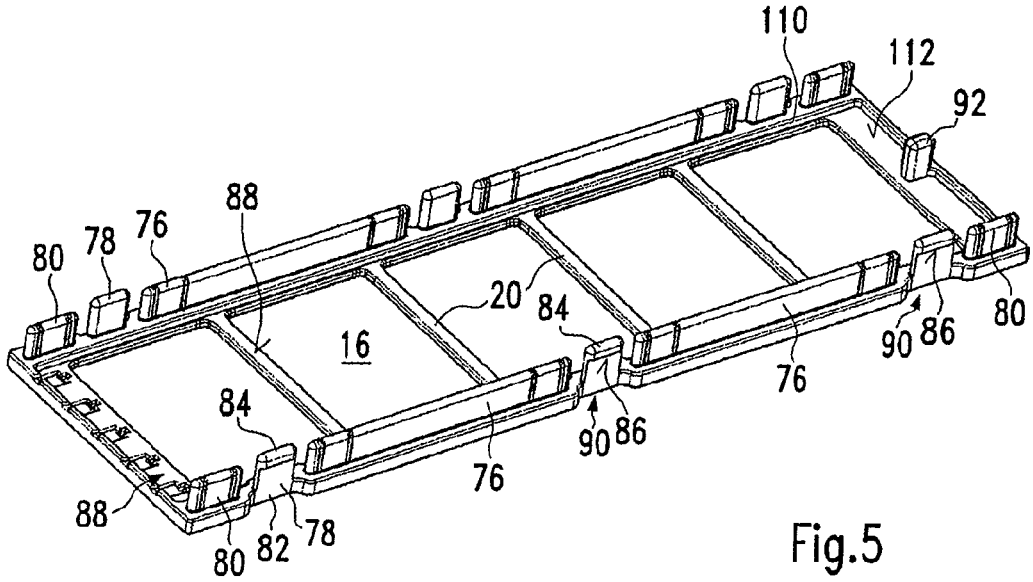
FIG. 5 a perspective side view of the housing upper part of the electrical heating device according to FIG. 1.

The housing upper part 6 shown in perspective illustration in FIG. 5 also has exclusively functional or delimiting surfaces aligned orthogonal or parallel to the corresponding housing opening 16. As functional surfaces in particular the guide areas of the previously mentioned guide pins 76, 78, 80 are provided which can be introduced into the corresponding pin guides 68, 70, 72. The guide pins 78 are moulded as notched pins and form latching ridges 82, over which on the upper side a thickened head of the notched pin 78 protrudes, which form a latching surface 86 which extends parallel to the plane which also contains the frame opening 16. The latching ridges 82 extend from the upper side of a cover 88, which is formed essentially as a flat component and produces the frame opening 16 and furthermore contains the outer surface of the struts 22. The cover 88 is formed frame-shaped as a cover for the housing lower part 4. Accordingly, the guide pins 76 to 80 extend from the inner side of the cover 88 at right angles. A recess 90 is provided for the latching ridges 82. In the region of the recess 90 the edge surface of the cover 88 is drawn inwards so that the flat, even side surface of the latching ridge 82 extends parallel to the guide surfaces of the guide pins 76 or 80, but is located inward to the respective outer guide surface of these guide pins 76, 80. The inner surfaces of the corresponding guide pins 78 to 80 facing the heating block 8 nevertheless lie in one plane.

On one face side of the housing upper part 6, on the inner wall of the cover 88, five recesses are formed corresponding to the five contact lug receptacles 48 which form part of the slots 15 and also comprise an upper margin region of the contact lugs 14 after the assembly of the heating block in the closed housing. On the oppositely situated face side a further guide pin 92 is provided, which interacts with a corresponding further guide receptacle cut out on the housing lower part 4, but does not fit into the fitting element receptacles 22 or the contact lug receptacles 48, so that it is ensured that the housing upper part 6 is placed on the housing lower part 4 and joined to it in a predetermined and unambiguous manner. Also the walls enclosing the further pin guide 94 and forming the guide pin 92 extend at right angles to the plane located on the frame opening 16 or 18.

Figure 8:
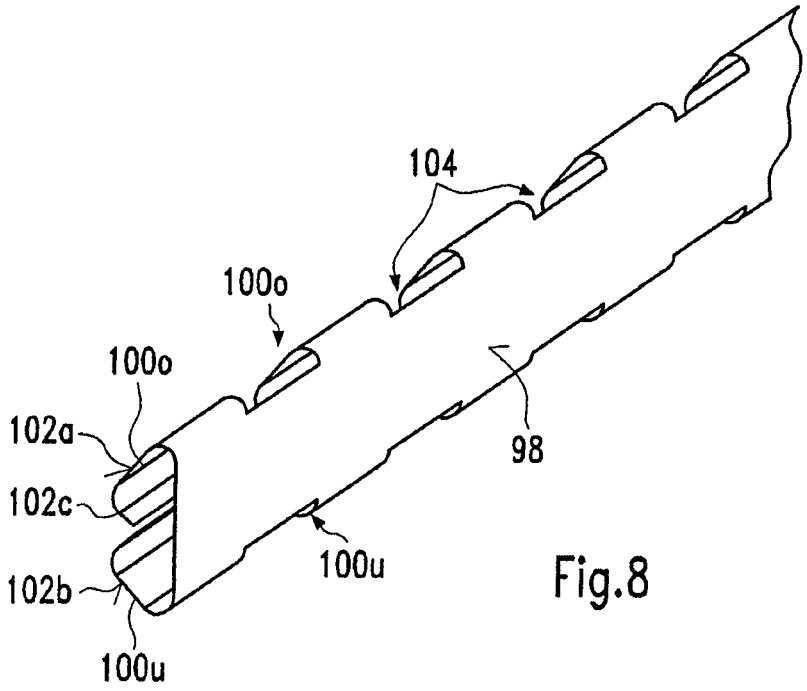
FIG. 8 a perspective side view of a spring element for prestressing the heating block of the embodiment illustrated in FIGS. 1 to 7.
Figure 9:
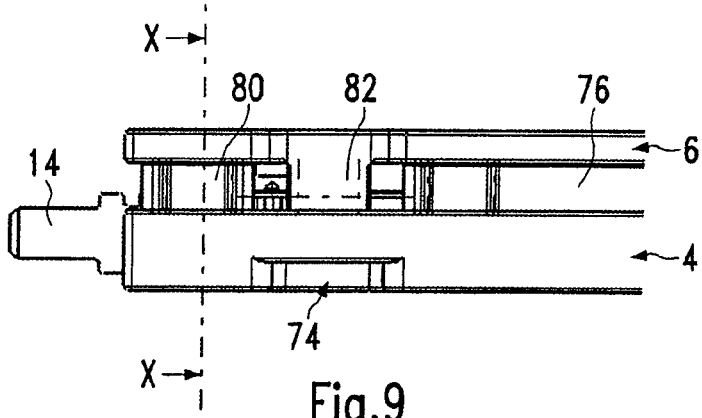
FIG. 9 a side view of an end of the example according to FIG. 1 before joining the housing parts.

FIG. 8 illustrates a perspective side view of a spring element 96, which contacts the heating block 8 at the edge and is located in its installation position at the level of the heating block 8. The front side of the spring element 96 in FIG. 8 forms a flat locating face 98 to which the adjacent, the uppermost in FIG. 3, heat dissipating element contacts with its vanes. Put more accurately, the face side bent ends of more meandering vanes of the corrugated rib band 12 contact this locating face 98. The locating face 98 is formed by an initially flat sheet metal band, on which transversely protruding spring limbs 100 have been formed by punching on both sides, which lie initially within the plane of the locating face 98 and after punching have been brought into the shape recognisable in FIGS. 8, 10, 11 and 12 by bending. Two spring limbs 100*o*, 100*u* lie overlapping in the width direction, i.e. transverse to the longitudinal extent of the flat locating face 98 and thus in the insertion direction of the spring element 96 during assembly. Each individual spring limb 1000, 100*u* forms the sloping sliding surface 102*a*, 102*b*, 102*c*, which in each case includes an angle of between 35 and 55°, preferably about 45°, between it and the flat locating face. Between the pairs of spring limbs 100 provided one behind the other in the longitudinal direction of the spring element 96 there are flat segments 104 in which the spring element 96 is formed as a rectangular flat sheet metal band.

Figure 4:
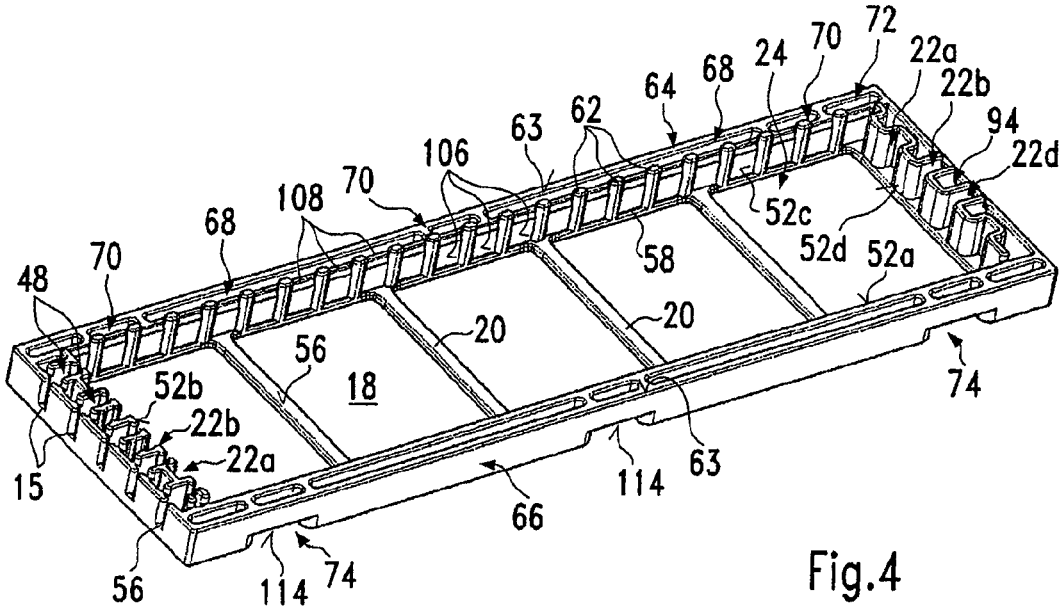
FIG. 4 a perspective side view of the embodiment illustrated in FIGS. 1 to 3.

The spring element 96 illustrated in FIG. 8 has pairs of spring limbs 100*o*, 100*u* corresponding to the number of intervening spaces between the individual spacers 62 on the longitudinal spar 64 (cf. FIG. 4). Each pair of spring limbs 100*o*, 100*u* lies in the installation position of the spring element 96 between these spacers 62. The flat segment 104 spans the width of the spacers 62 and joins together adjacent pairs of spring limbs 100*o*, 100*u*. The correspondingly manufactured spring can thus be introduced as a one-part component into the housing 2, in particular into the housing lower part 4, which simplifies the manufacture of the electrical heating device. The wall sections of the frame surface 42*c* provided between adjacent spacers 62 accordingly form a supporting surface 106 for the respective pairs of spring limbs 100. Due to the matching of the spring element 100, in particular of the embodiment of the flat segments 104 between the pairs of overlapping spring limbs 100, it is not possible to introduce the spring element 96 into the housing lower part 4 in the incorrect alignment. The spring element 96 can then only be pushed into its installation position, in which the spring element is accommodated at the level of the heating block 8 in the housing 2 when the flat locating face 98 is aligned to the heating block. Furthermore, the heating block is held by the spacers 62 at a distance to the supporting surfaces 106 so that the spring element 96 can contact these surfaces at any time on introduction into the housing lower part 4 and without hindrance by the heating block 8.

With a continuing insertion movement of the spring element 96 in the direction of the heating block 8, i.e. with continuing insertion into the heating block, the spring element 96 is then forced in the direction of the heating block 8 due to the spring force from the lower spring limb 100*u*, so that the layers 10, 12 of the heating block are compressed. The flat locating face 98 with the adjacent heat dissipating element 12 already has a covering such that with a continuing insertion movement the spring element 96 is sufficiently guided in the insertion direction between the heating block 8 and the housing lower part 4. Finally, with continued insertion the lower spring limb 100*u* is elastically compressed. The counter force on the housing side is here formed by an upper edge 108, which is formed between the supporting surface 106 and the inner surface of the longitudinal spar 64 by the meeting point of the two surfaces. This edge 108 initially forces the lower spring limb 100*u* inwards on the introduction of the spring element 96. With a continued introduction movement the upper spring limb 100*o* is finally forced inwards by the interaction of the free end of the corresponding spring limb 100 which is bevelled inwards and bent.

Figure 10:
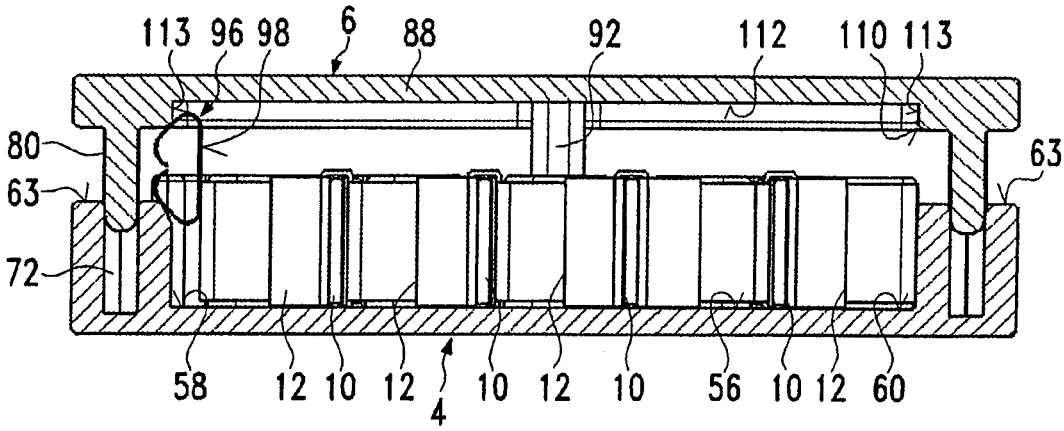
FIG. 10 a sectional view along the line X-X according to the illustration in FIG. 9.
Figure 11:
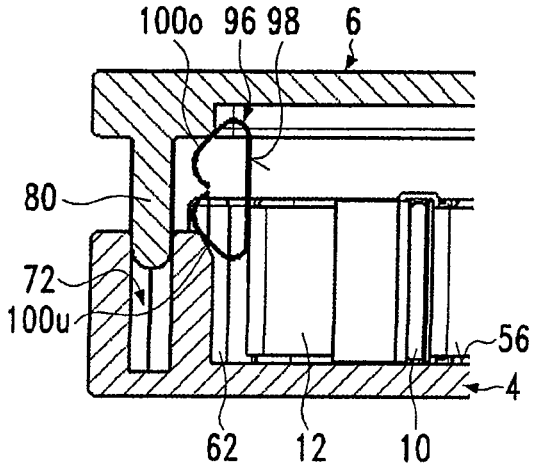
FIG. 11 an enlarged detail view of the detail A in FIG. 10.

As can be seen from FIGS. 10, 11 and 12, the housing 2 has a further housing element which interacts with the spring element 96. This further housing element is formed by an edge 110 of the housing upper part 6, which is formed between the inner surface of the cover 88 and a bottom 112 of the housing upper part 6, and in fact by the joining edge of an outer edge 113 delimiting the bottom 112 of the housing upper part with the inner surface of the cover 88. The height offset between this bottom 112 and the inner surface of the cover 88 takes into account that the heating block 8 protrudes over the surface 63 formed by the longitudinal spars 64, 66, and in fact approximately with the same length as the spacers 62 protrude over the inner surface 63 of the longitudinal spars 64, 66. The edge 110 contacts a sloping sliding surface 102*a* of the spring element 96 which is formed by the upper spring limb 100*o*. As emerges from FIGS. 10 and 12*a*, the upper end of the spring element 96 is in a state essentially free of contact pressure with spacing to the bottom 112 of the housing upper part 6.

For the description of the assembly reference is made in the following to FIGS. 12*a* to 12*e*. First the individual layers 10, 12 are introduced into the housing lower part 4. Then the spring element 96 is manually inserted part way into the housing lower part, in each case so far until the layers of the heating block 8 are located against one another and the spring element 96 is placed sufficiently deeply between the heating block 6 and the frame surface 52*c*.

This initial introductory movement, through which the spring element 96 essentially introduces no spring pressure into the heating block 8, guides the spring element 96 over the face side surfaces of the spacers 62 facing the heating block 8, which interact with the flat segments 104 of the spring element 96. Due to the contacting of the spring element 96 and spacers 62, the spring element 96 is aligned with its flat locating face 98 parallel to the layers 4, 6 of the heating block. After this first assembly step the spring element 96 protrudes over the plane taken up by the heating block 8 by a longitudinal section which is identified with L in FIG. 12*a*. Then the housing upper part 6 is placed on the housing lower part 4. The guide pins 76, 78, 80, 92 here engage in the corresponding pin guides 68, 70, 72, 94. In doing this, the spring element 96 remains initially essentially free of stress. In this state sufficient coverage between the guide pins and the corresponding recesses can already be achieved so that both housing parts 4, 6 can only be moved in a linear direction relative to one another. Then follows the joining of the housing parts 4, 6 with the application of the spring force.

Figure 12A:
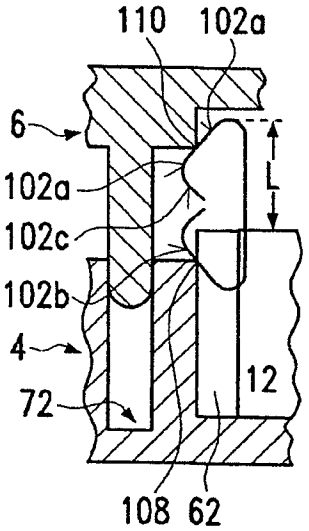
FIGS. 12*a* to 12*e* enlarged detail views similar to the view according to FIG. 11 in various states during joining the housing parts.
Figure 12B:
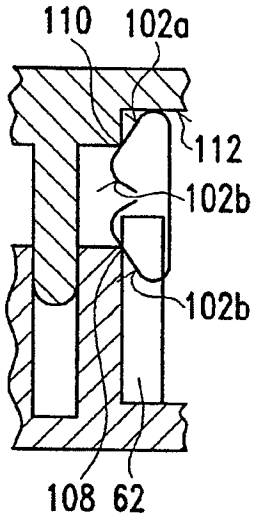
Figure 12C:
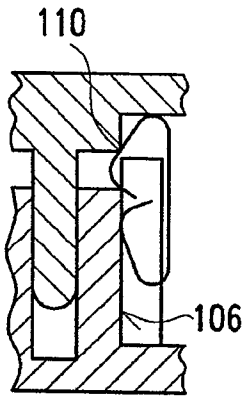
Figure 12D:
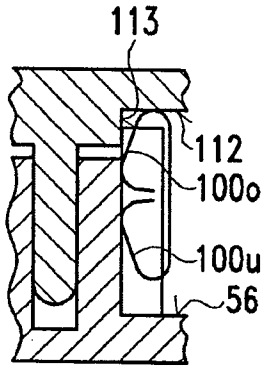
Figure 12E:
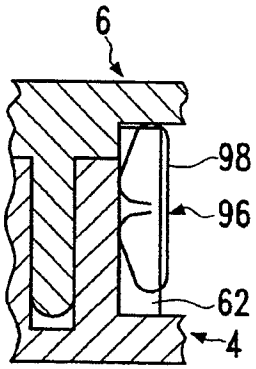

First, the spring limbs 100*o*, 100*u* are slightly compressed until the bottom 112 of the housing upper part 6 meets the upper end of the spring element 96 (cf. FIG. 12*b*). The two edges 108 and 100 have here already slid a certain way along the sloping sliding surfaces 102*a* and 102*b*. The upper spring limb 100*o* is in this way already bent elastically so far inwards that with increasing insertion movement the free end of the limb 1000 bent inwards at the centre of the spring element 96, which forms a further sloping sliding surface 102*c* can reliably pass the edge 108. Thereafter, a continuing joining movement between the two housing parts 4, 6 also leads to the spring element 96 being carried along. Here, initially the edge 108 produces a further elastic stressing of the lower spring limb 100*u*. This lower spring limb 100*u* is finally completely accommodated between the supporting surface 106 and the heating block 8 (FIG. 12*c*). With increasing insertion of the spring element 96 into the housing lower part 4 the upper spring limb 100*o* is finally also elastically deformed by the interaction of the edge 108 with this upper spring limb 100*o* in the direction of the heating block 8 and accordingly produces a spring force. This elastic spring force is mainly produced in that the edge 108 slides down the further sloping sliding surface 102*c* and forces the upper spring limb 100*o* in the direction of the heating block 8 (intermediate step between FIG. 12*c* and FIG. 12*d*). The spring element 96 has reached its final position when the two housing parts 4, 6 contact one another with their respective surfaces aligned to one another. The spring element 96 is stressed and held in this installation position due to the spring force between the heating block 8 and the frame surface 52*c*. If the spring element 96 is pushed from outside by an unintentional force, the limit stop 58 or the bottom 112 of the housing upper part 6 in each case prevents the spring element 96 being forced out of the housing 2.

Shortly before the two housing parts 4, 6 contact one another, heads 84, which are guided in the guide channels under slight elastic bending of the latching ridges 82 in the pin guides 70, are forced outwards, so that their latching surface 86 contacts a latching counter surface 114 or it protrudes beyond it with slight play, so that both housing parts 4, 6 are fixed together captively.

As the above description explains, during the manufacture of the electrical heating device according to the discussed embodiment, on closing the housing by joining the housing lower part and housing upper part, the spring element is brought into its installation position in which the spring element is located at the level of the heating block, i.e. it is arranged in the plane which is also taken up by the heating block. Furthermore, the spring element is only put under spring pressure on introduction and only then when the two housing parts 4, 6 are guided relative to one another by the positive locking engagement of the guide pins 76 to 80 in the corresponding pin guides 68, 70, 72. The constructive development accordingly offers the possibility of introducing the components of the heating block into the receptacle 24 formed by the housing 2 without tension being applied. It is only thereafter that spring stressing follows and in fact this occurs on making contact and in housing parts 4, 6, limited with respect to one another in position. If thereafter, due to the spring pressure produced, on joining the housing parts 4, 6, displacement of the elements of the heating block 8 or even forcing out of the elements of the heating block 8 from the receptacle 24 occurs, these parts are held by the parts of the housing parts 4, 6 enclosing the heating block in the housing 2 and forced back into the desired position on joining the housing parts 4, 6.

With regard to the constructive development the present invention is not restricted to the embodiment described. Thus, a spring element can for example be provided which has a spring limb which in the installation position is initially essentially free of stress. This spring element is introduced without stress with the heating block into the receptacle 24. The spring element has a spring limb and the spring limb forms a sliding surface sloping obliquely outwards and downwards in the direction onto the limit stop 58, and in fact for a pin, which interacts with the spring element and sets the corresponding spring limb during the joining of the housing upper part and housing lower part under spring pressure such that the spring element overall contacts the heating block 8 under spring pressure. With this embodiment the spring element is initially accommodated without stress together with the heating block in the housing lower part and however remains stationary relative to the joining direction on production of the spring pressure. The spring element is just pushed slightly in the plane of the heating block and contacts the heating block. Furthermore, the spring limb or limbs are pivoted to produce the elastic stress. The special development of the heat generating elements 10 facilitates a more simple assembly, because the grid arrangement formed by the first and second struts 20, 43 is not a complete part of the housing, but rather the second struts with the positional frames 28 are formed and thus are reliably located where the PTC heating elements 30 come to rest within the heating block 8. Compared to the prior state of the art in which the grid arrangement is solely formed by the housing parts, housing parts can be accordingly manufactured which are relatively simply formed. Furthermore, higher tolerances can be permitted, because no one-part struts joined to the housing exist which extend parallel to the layers of the heating block 8 and must be provided exactly at the position of the heat generating elements 10. Through the dimensioning of the struts 20 and the passage 41 and in particular the insertion of the struts 20 between two sections of the retaining ridges 40 there is still the possibility of supporting the first and second struts 20, 43 with positive locking with respect to one another and thus of stiffening the housing overall.

Since the heat dissipating element 12 is prepared as a preassembled unit and furthermore it is ensured by the fitting elements 26 and the associated receptacle 22 that the heat generating elements 12 can only be installed at certain places within the housing 2, the production of the electrical heating device, in particular the assembly of the individual parts can also be carried out by less skilled personnel.

The definitive arrangement of the embodiment gives an unambiguous assignment of different components of the electrical heating device. If this unambiguous assignment is not maintained, the components of the electrical heating device cannot be assembled.

The invention claimed is:

1. An electrical heating device comprising:

a flat heating block, which is held in a housing forming oppositely situated frame openings and which comprises parallel layers of longitudinally extending heat dissipating and heat generating elements, wherein each of the heat generating elements has at least one PTC-heating element, sheet metal bands which contact opposite side surfaces of the at least one PTC-heating element, and a fitting element; wherein a plurality of fitting element receptacles is formed on the housing, wherein each of the fitting element receptacles is assigned to and receives a corresponding one of the fitting elements, wherein each fitting element is introduced into the assigned fitting element receptacle, and wherein at least one of the fitting element receptacles is formed with at least one of a different length in the longitudinal direction of the heat generating elements and a different width in a direction transverse to the heat generating elements than at least one other of the fitting element receptacles.

2. The electrical heating device according to claim 1, wherein the housing comprises a housing lower part which forms a receptacle for the heating block and a frame surrounding the receptacle as well as the fitting element receptacles, and a housing upper part, which is joined to the housing lower part to enclose the heating block, wherein the fitting element receptacles are formed such that the fitting elements can be inserted into the housing lower part in a direction transverse to the extended direction of the heating block.

3. The electrical heating device according to claim 2, wherein the housing upper part has guide pins which project from a cover of the housing upper part enclosing the heating block, which are formed within the cover in a single part, and which are in engagement with pin guides which are cut out correspondingly on the housing lower part, and wherein the guide pins and the pin guides are formed correspondingly on both housing parts such that the two housing parts can only be joined together with a particular alignment.

4. The electrical heating device according to claim 3, wherein functional surfaces forming the receptacle and the pin guides and contour surfaces defining the outer contour of the housing lower part, as well as functional surfaces forming the guide pins as well as delimiting surfaces of the housing upper part delimiting the cover, run exclusively parallel or perpendicular to a plane comprising the frame opening.

5. The electrical heating device according to claim 3, wherein all functional, contour and delimiting surfaces of the housing parts extend exclusively parallel or perpendicular to a plane containing the frame opening, and wherein only edge surfaces between surfaces or face sides meeting at right angles are bevelled or rounded off.

6. The electrical heating device according to claim 1, wherein the fitting elements are formed on a face side of the housing protruding over the heating block, and wherein the fitting element receptacles open to a receptacle accommodating the heating block.

7. The electrical heating device according to claim 1, wherein the fitting elements are formed by retainers which hold adjacently provided PTC heating elements of each heat generating element in position.

8. The electrical heating device according to claim 1, wherein the fitting elements are formed by the ends of positional frames of an insulating material, the frames forming adjacently provided receptacles for receiving, in each case, at least one PTC heating element of each heat generating element.

9. An electrical heating device comprising:

a flat heating block comprising parallel layers of heat dissipating and heat generating elements, each of the heat generating elements having a fitting element, a housing on which is formed a plurality of fitting element receptacles, each of which is associated with and receives a corresponding one of the fitting elements, the housing forming oppositely situated frame openings, wherein the housing comprises a housing lower part, which forms a receptacle for the heating block and a frame surrounding the receptacle as well as the fitting element receptacles, and a housing upper part, which is joined to the housing lower part to enclose the heating block, wherein the heat generating elements comprise at least one PTC-heating element and sheet metal bands to which the PTC-heating elements make electrical contact, wherein the sheet metal bands on the face side of the heating block are brought out of the plane of the associated heat generating element by bending and are passed through slots which are cut in the face side of the housing, and wherein the bent sheet metal bands of different heat generating elements and the associated slots are formed such that the heat generating elements cannot be inserted at just any random place in the housing, wherein the housing upper part has guide pins which project from a cover of the housing upper part enclosing the heating block, which are formed with it in a single part, and which are in engagement with pin guides which are cut out correspondingly on the housing lower part, wherein the guide pins and the pin guides are foliated correspondingly on both housing parts such that the two housing parts can only be joined together with a particular alignment, further comprising at least one spring element accommodated in the housing, through which the heating block is held under pretension in the housing, and wherein the housing lower part forms locating faces for the at least one spring element, which run exclusively parallel or perpendicular to the plane comprising the frame opening.

10. The electrical heating device according to claim 9, wherein selected guide pins are formed as notched pins, wherein the pin guides assigned to these notched pins open into a window opening to the outer side of the housing lower part, and wherein latching surfaces formed on the notched pin and latching counter surfaces formed by the window extend parallel to a plane comprising the frame opening.

11. The electrical heating device according to claim 10, wherein a ridge of the notched pin carries a latching surface that protrudes beyond the notched pin, and wherein the ridge of the notched pin extends from the outer surface of the cover from a recess which is formed on the outer edge of the cover.

12. An electrical heating device comprising:

a fiat heating block which is held in a housing forming oppositely situated frame openings and which comprises parallel layers of heat dissipating and heat generating elements, wherein each of the heat generating elements has at least one PTC-heating element, sheet metal bands which contact opposite side surfaces of the at least one PTC-heating element, and a fitting element; wherein a plurality of fitting element receptacles is formed on the housing, wherein each of the fitting element receptacles is assigned to and receives a corresponding one of the fitting elements, wherein each fitting element is introduced into the assigned fitting element receptacle, wherein the fitting elements and the corresponding fitting element receptacles are formed such that the heat generating elements cannot be inserted at just any random place in the housing, and wherein sheet metal bands make electrical contact with the PTC heating elements of the heat generating elements and, on a face side of the heating block, are brought out of the plane of the associated heat generating element by bending, and wherein the sheet metal bands pass through slots which are cut in a face side of the housing, and wherein the bent sheet metal bands of different heat generating elements and the associated slots are formed such that the heat generating elements cannot be inserted at just any random place in the housing.

13. An electrical heating device comprising:

a fiat heating block which is held in a housing forming oppositely situated frame openings and which comprises parallel layers of heat dissipating and heat generating elements, wherein each of the heat generating elements has at least one PTC-heating element, sheet metal bands which contact opposite side surfaces of the at least one PTC-heating element, and a fitting element; wherein a plurality of fitting element receptacles is formed on the housing, wherein each of the fitting element receptacles is assigned to and receives a corresponding one of the fitting elements, wherein each fitting element is introduced into the assigned receptacle, the fitting elements and the corresponding fining element receptacles are formed such that the heat generating elements cannot be inserted at just any random place in the housing, and wherein the fitting element of one of the heat generating elements and the corresponding fitting element receptacle are collectively of a different geometry than the fitting element of another of the heat generating elements and a corresponding fitting element receptacle.

14. An electrical heating device comprising:

a housing which forms oppositely situated frame openings and which a plurality of fitting element receptacles formed thereon;

a heating block which comprises parallel layers of heat dissipating and heat generating elements, each of which has a fitting element, wherein the housing defines a receptacle accommodating the heating block, wherein the fitting element receptacles are open to the receptacle accommodating the heating block, wherein each heat generating element comprises at least one PTC-heating element and sheet metal bands which contact opposite side surfaces of the PTC heating elements, wherein each of the fitting element receptacles is assigned to and receives a corresponding one of the fitting elements, and wherein the fitting element of one of the heat generating elements and the corresponding fitting element receptacle are collectively of a different geometry than the fitting element of another of the heat generating elements and a corresponding fitting element receptacle so that the heat generating elements cannot be inserted at just any random place in the housing.

15. An electrical heating device comprising:

a housing which forms oppositely situated frame openings and which has a plurality of fitting element receptacles formed thereon;

a heating block which comprises parallel layers of heat dissipating and heat generating elements, each of which has a fitting element, wherein the housing defines a receptacle accommodating the heating block, wherein the fitting element receptacles are open to the receptacle accommodating the heating block, wherein each heat generating element comprises at least one PTC-heating element, sheet metal bands which contact opposite side surfaces of the PTC-heating elements, and a positional frame providing a receptacle for the at least one PTC-heating element, wherein the heat generating element is formed as a preassembled component, wherein each of the fitting element receptacles is assigned to and receives a corresponding one of the fitting elements, and wherein the fitting element of one of the heat generating elements and the corresponding fitting element receptacle are collectively of a different geometry than the fitting element of another of the heat generating elements and a corresponding fitting element receptacle so that the heat generating elements cannot be inserted at just any random place in the housing.

* * * * *

UNITED STATES PATENT AND TRADEMARK OFFICE

CERTIFICATE OF CORRECTION

PATENT NO. : 8,680,435 B2
APPLICATION NO. : 12/174396
DATED : March 25, 2014
INVENTOR(S) : Franz Bohlender et al.

It is certified that error appears in the above-identified patent and that said Letters Patent is hereby corrected as shown below:

IN THE CLAIMS

| | |
|---|---|
| Col. 17, Line 57, Claim 9, | Replace “foliated” with “formed” |
| Col. 18, Line 59, Claim 13, | Replace “fining” with “fitting” |

Signed and Sealed this
Twenty-seventh Day of May, 2014

Michelle K. Lee

Michelle K. Lee
*Deputy Director of the United States Patent and Trademark Office*